US007041629B2

(12) United States Patent
Schonfelder et al.

(10) Patent No.: US 7,041,629 B2
(45) Date of Patent: May 9, 2006

(54) STRIPPER FOR SPECIAL STEEL

(75) Inventors: Eckart Schonfelder, Idstein (DE); Gunther Schwane, Frankfurt am Main (DE); Harald Werner, Sinzheim (DE)

(73) Assignee: Chemetall GmbH, Frankfurt a.M. (DE)

( * ) Notice: Subject to any disclaimer, the term of this patent is extended or adjusted under 35 U.S.C. 154(b) by 391 days.

(21) Appl. No.: 10/648,658

(22) Filed: Aug. 26, 2003

(65) Prior Publication Data

US 2004/0053801 A1 Mar. 18, 2004

Related U.S. Application Data

(63) Continuation of application No. 09/743,396, filed as application No. PCT/EP99/05226 on Jul. 22, 1999, now abandoned.

(30) Foreign Application Priority Data

Jul. 29, 1998 (DE) ..... 198 33 990

(51) Int. Cl.
*C23G 1/02* (2006.01)
*C23G 1/08* (2006.01)

(52) U.S. Cl. ..... 510/245; 510/257; 510/258; 510/263; 510/269; 134/2; 134/3; 134/10; 148/240; 148/259; 148/260; 252/79.4

(58) Field of Classification Search ..... None
See application file for complete search history.

(56) References Cited

U.S. PATENT DOCUMENTS

| | | | | | |
|---|---|---|---|---|---|
| 2,698,781 | A | | 1/1955 | Meyer | |
| 3,239,467 | A | | 3/1966 | Lipinski | |
| 4,971,631 | A | * | 11/1990 | Sallee et al. | 510/100 |
| 5,164,016 | A | * | 11/1992 | Henriet et al. | 134/2 |
| 5,332,446 | A | * | 7/1994 | Didier et al. | 134/3 |
| 5,690,748 | A | * | 11/1997 | Henriet | 134/3 |
| 5,702,534 | A | * | 12/1997 | Rodabaugh et al. | 134/7 |
| 5,711,996 | A | * | 1/1998 | Claffey | 427/388.4 |
| 5,868,820 | A | * | 2/1999 | Claffey | 106/14.44 |
| 6,033,485 | A | * | 3/2000 | Didier et al. | 134/3 |

FOREIGN PATENT DOCUMENTS

| | | | |
|---|---|---|---|
| DE | 19 50 560 | A | 4/1970 |
| DE | 25 07 059 | A | 9/1976 |
| DE | 35 30 132 | A | 2/1987 |
| DE | 42 37 021 | C | 2/1994 |
| EP | 0 058 257 | A | 8/1982 |
| FR | 2 520 374 | A | 7/1983 |
| JP | 56 010396 | A | 2/1981 |
| WO | WO-95 35397 | A | 12/1995 |

OTHER PUBLICATIONS

Patent Abstract of Japan, vol. 005, No. 058, Apr. 21, 1981.

* cited by examiner

*Primary Examiner*—Gregory Webb
(74) *Attorney, Agent, or Firm*—Fulbright & Jaworski L.L.P.

(57) ABSTRACT

The inventive aqueous pickling agent on the basis of sulfuric acid or phosphoric acid and hydrogen fluoride for stainless steels, which pickling agent is free of wetting and emulsifying agents, contains (each as 100 wt-% substance)

1.5 to 16 wt-% sulfuric acid or
2.0 to 30 wt-% phosphoric acid as well as 0.5 to 14 wt-% hydrogen fluoride and
0.5 to 15.5 wt-% acid-soluble aromatic nitro compound.

An iron(III) compound is not supplied to said pickling agent. Merely in the starting phase, an oxidizing agent can be supplied, which oxidizes iron(II) to form iron(III).

As acid-soluble aromatic nitro compound m-nitrobenzene sulfonate and/or 3-nitrophthalate are particularly advantageous.

The inventive pickling agent can be used as bath pickle and —when adding 2.5 to 5.5 wt-% magnesium and/or magnesium compound (calculated as Mg)—also as spraying pickle or brush pickle.

13 Claims, No Drawings

STRIPPER FOR SPECIAL STEEL

This is a continuation of U.S. application Ser. No. 09/743,396, filed Mar., 29, 2001, which is now abandonded. U.S. application Ser. No. 09/743,396 is a 371 of PCT/EP99/05226 filed Jul. 22, 1999.

This invention relates to an aqueous pickling agent on the basis of sulfuric acid or phosphoric acid and hydrogen fluoride for stainless steels, which pickling agent is free of wetting and emulsifying agents.

It is common practice to pickle stainless steels with various acids or acid mixtures (pickling agents), in order to remove corrosion products as well as e.g. layers of scale or tarnishing colors produced during welding. The pickling agents may be used as bath pickle or—in particular in the case of large parts or a local formation of oxides—as spraying pickle or as brush pickle.

The most important acids or acid mixtures for pickling stainless steels are hydrofluoric acid, hydrofluoric acid/nitric acid, hydrofluoric acid/sulfuric acid with in part considerable additions of iron(III) compounds already in the starting phase of the pickling agent. The pickling agents in part contain hydrogen peroxide, by means of which the iron(II) ions dissolved by the pickling attack are oxidized to form iron(III) ions. Examples for such pickling agents are described in WO 87/01 739, DE-A-38 25 857, DE-A-44 17 284, EP-A-505 605 and EP-A-596 273.

The known pickling agents have all kinds of disadvantages. One disadvantage frequently is the low pickling rate. Too high a pickling rate can also have a disadvantageous effect, when cycle times are predetermined in the pickling plants. This is true in particular for pickling agents on the basis of hydrofluoric acid/nitric acid. Moreover, when using these pickling agents with high acid concentrations, vapors which are dangerous to health escape from the pickling baths, which vapors must be sucked off and be treated in a washing plant. Due to the high solubility of the nitrates, processing the rinsing and waste waters obtained in the pickling process is difficult. Low-concentration pickling agents on the basis of hydrofluoric acid/nitric acid in addition suffer from the disadvantage that dark mottled metal surfaces are obtained and not the actually desired metallically bright metal surfaces. Pickling agents which for adjusting the required redox potential have considerable additions of Fe(III) compounds already in the starting phase have a deficiency in so far as the capacity to absorb Fe(II) and Fe(III) originating from the oxide coating of the pickling material is reduced corresponding to the added amount of Fe(III).

The processes using pickling agents on the basis of sulfuric acid/hydrofluoric acid/hydrogen peroxide, which are employed when dipping and for which a certain redox potential should be maintained in general, involve a comparatively complex procedure, so that they cannot be considered in particular for smaller pickling plants. It is furthermore disadvantageous that the hydrogen peroxide in the pickling agent is decomposed relatively easily, and with a small addition of peroxide only a slow dissolution of oxide, i.e. a low pickling rate is obtained.

Another process consists in a so-called single-bath degreasing and pickling of articles containing iron or made therof. In this process, solutions are employed which contain acids, wetting and/or emulsifiying agents as well as aromatic, water-soluble nitro compounds, such as nitrobenzene sulfonate, as oxidizing agents (DE-A-25 07 059). The single-bath degreasing and pickling necessarily leads to the introduction of oils or fats into the pickling bath, whereby the pickling process is influenced in a non-calculable manner. In particular, the formation of a uniform pickling pattern is prevented. The content of wetting and/or emulsifying agents in addition renders the processing of the rinsing and waste waters obtained in the pickling process more difficult.

Finally, from the U.S. Pat. No. 2,698,781 a process referred to as dissolution of metals is known, in which aqueous, strong acids containing an aromatic nitro compound are employed. In consideration of the examples, this process is primarily intended for the treatment of nickel-plated copper as well as copper and lead. Merely one example describes the pickling of stainless steels by means of a pickling bath containing sulfuric acid, m-nitrobenzene sulfonic acid and hydrofluoric acid, in which the sulfuric acid concentration is 200 g/l. However, pickling baths with such a high concentration of sulfuric acid work comparatively slowly, so that the throughput capacity is low.

It is the object of the invention to provide an aqueous pickling agent for stainless steels, which does not have the known, in particular the aforementioned disadvantages, and which can be used in a simple and inexpensive process.

This object is solved in that the pickling agent as mentioned above is formulated in accordance with the invention such that it contains (each as 100 wt-% substance) 1.5 to 16 wt-% sulfuric acid or 2.0 to 30 wt-% phosphoric acid as well as 0.5 to 14 wt-% hydrogen fluoride and 0.5 to 15.5 wt-% acid-soluble aromatic nitro compound, to which merely in the starting phase an oxidizing agent can be supplied, which oxidizes iron(II) to form iron(III).

In principle, the inventive pickling agent used for performing the pickling process can also be employed in the starting phase without oxidizing agent oxidizing iron(II) to form iron(III). For activating the freshly prepared pickling agent it may, however, be advantageous to add small amounts of oxidizing agent, for instance 0.05 wt-% based on peroxide compounds.

The inventive pickling agent may be employed as bath pickle, as spraying pickle or as brush pickle. Since the pickling agent is free of wetting and emulsifying agents, care should be taken that the pickling material can completely be wetted by the pickling agent. If oil or fat residues on the pickling material impair the complete wettability, a preceding cleaning or degreasing with the usual cleaning agents and a thorough rinsing with water should be effected before the pickling process.

In accordance with a particularly preferred aspect of the invention, a pickling agent is used which in its application as bath pickle contains 5.0 to 11 wt-% sulfuric acid or 8.0 to 20 wt-% phosphoric acid as well as 4.0 to 10 wt-% hydrogen fluoride and 4.5 to 11 wt-% acid-soluble aromatic nitro compound. The pickling agent with the aforementioned concentration ranges is characterized by a sufficiently high pickling rate, without the base material being attacked. In addition, it is particularly inexpensive.

In its application as spraying or brush pickle, the pickling agent preferably contains 2.5 to 5.5 wt-% magnesium compound (calculated as Mg).

By adding magnesium in the indicated amounts, the pickling agent is converted to a thixotropic gel. This ensures the application of a sufficient amount of the pickling agent required for the pickling process. Particularly advantageously, the magnesium should be added in metallic form, as magnesium oxide, hydroxide, carbonate or sulfate.

In accordance with a preferred aspect of the invention it is therefore provided to use the pickling agent in its application as spraying pickle with a content of 9.5 to 15.5 wt-% sulfuric acid or 15.0 to 30.0 wt-% phosphoric acid as well as 4.0 to 11.0 wt-% hydrogen fluoride, 4.5 to 11.5 wt-% acid-soluble aromatic nitro compound and 2.5 to 4.5 wt-% magnesium compound (calculated as Mg).

In another preferred embodiment of the invention, the pickling agent in its application as brush pickle contains 12.0 to 16.0 wt-% sulfuric acid or 18.0 to 30.0 wt-% phosphoric acid as well as 4.5 to 12.0 wt-% hydrogen fluoride, 2.5 to 9.5 wt-% acid-soluble aromatic nitro compound and 3.0 to 5.5 wt-% magnesium compound (calculated as Mg).

Suitable acid-soluble aromatic nitro compounds are those which have at least one nitro group and at least one acid group, in particular a carboxyl or sulfonic acid group, at the benzene ring. It is particularly advantageous to use m-nitrobenzenesulfonate and/or 3-nitrophthalate as acid-soluble aromatic nitro compound.

The temperatures at which the inventive pickling agents are used differ depending on the application. For the application as bath pickle the temperatures are adjusted to a value in the range from 15 to 80° C. The pickling time is 5 to 90 min, depending on the degree of scaling or the oxide coating of the pickling material, the shorter pickling times being used for the higher pickling temperatures and the longer pickling times being used for the lower pickling temperatures. When the pickling agent is used as spraying or brush pickle, the pickling temperatures generally are predetermined by the existing room or ambient temperatures. In general, they lie between 15 and 35° C. The required pickling time is about 15 to 180 min.

By means of the inventive pickling agent a simpler and less expensive pickling process can be performed. Due to the intended moderate removal of material achieved with the inventive pickling agent, bright velvety surfaces are achieved. Processing the rinsing and waste waters is easy, as by means of e.g. lime milk the pickling agent components can be precipitated and separated as hardly soluble calcium compounds.

The invention will subsequently be explained in detail with reference to the following examples.

EXAMPLE 1

To determine the removal of material and the surface quality, metallically pure sheets of stainless steel grades 1.4541 and 1.4462 were treated for one hour at 30° C. in the pickling agent systems listed in the following Table. The percentages are understood to be % by weight.

The results are listed as regards the removal of material in $g/m^2$ in columns 2 and 3, and as regards the surface quality in column 4.

| No. | Pickling agent | Removal of material 1.4541 | Removal of material 1.4462 | Surface |
|---|---|---|---|---|
| 1 | 15% $HNO_3$/5% HF | 55.8 | 27.1 | silvery, slightly rough |
| 2 | 7% $H_2SO_4$/5% HF | 18.9 | 6.9 | surface coated greyish black |
| 3 | 7% $H_2SO_4$/5% HF 1% $H_2O_2$ | 46.3 | 17.6 | silvery, slightly rough |
| 4 | 7% $H_2SO_4$/5% HF 5% $H_2O_2$ | 41.1 | 16.2 | silvery, velvety |
| 5 | 7% $H_2SO_4$/5% $HBF_4$ 3% Fe(III) sulfate | 9.2 | 0.1 | bright, slightly mottled |

-continued

| No. | Pickling agent | Removal of material 1.4541 | Removal of material 1.4462 | Surface |
|---|---|---|---|---|
| 6 | 7% $H_2SO_4$/5% HF 5% m-nitrobenzene sulfonic acid | 32.8 | 10.8 | bright, velvety |
| 7 | 7% $H_2SO_4$/5% HF 5% m-nitrobenzene sulfonic acid 0.05% $H_2O_2$ in the starting phase | 36.4 | 11.2 | bright, velvety |

A comparison of the results shows that—except pickling agent no. 4—only the inventive pickling agents nos. 6 and 7 provided the desired bright, velvety surface. All the others provided slightly rough or mottled surfaces or surfaces coated greyish black. The removal of material with pickling agents nos. 6 and 7 is comparatively low.

EXAMPLE 2

Two steel sheets each of the stainless steel grades 1.4541 and 1.4462 with the dimensions 45×140 mm and connected by TIG welding with a longitudinal seam were dipped into a pickling agent of 30° C., which consisted of 5 wt-% hydrogen fluoride
7 wt-% sulfuric acid and
5.4 wt-% m-nitrobenzene sulfonate (introduced as Na salt)
rest water.

The pairs of sheets were visually inspected in an interval of 2 min for descaling of the welding seam and removal of tarnishing colors.

The pair of sheets of the material 1.4511 was clean after 10 min, the one of the material 1.4462 was clean after 24 min.

EXAMPLE 3

There was formulated a spraying pickle of
14 wt-% sulfuric acid (96 wt-%)
19 wt-% hydrofluoric acid (50 wt-%)
12.1 wt-% $MgCO_3$ and
9 wt-% Na-m-nitrobenzene sulfonate
rest water.

With a pressure of 6 bar, the clear viscous liquid obtained was sprayed onto sheets of steel grade 1.4301, which had a manually drawn welding seam. Due to its thixotropy, the film obtained in a thickness of 1 to 2 mm did not even flow on vertical surfaces.

After an exposure time of 1 hour, the spraying pickle was rinsed off. The welding seam was properly descaled. The entire sheet surface was uniformly bright and weakly pickled.

EXAMPLE 4

There was prepared a brush pickle of
24 wt-% phosphoric acid (85 wt-%)
14 wt-% hydrofluoric acid (70-wt %)
6.6 wt-% magnesium oxide, and
5 wt-% 3-nitrophthalic acid
rest water.

A no longer flowable, opaque paste was obtained, which by means of a brush was applied onto the welding seam of a sheet of stainless steel grade 1.4571 in a thickness of 2 to 3 mm.

After 2 hours, the pickling paste was rinsed off, and the welding seam was sprayed by means of a sharp jet of water. The welding seam was bright and blank, the oxide layer completely removed, and the base material free of a visible pickling attack.

The invention claimed is:

1. A pickling agent comprising:

water;

1.5 to 16 wt-% sulfuric acid or 2.0 to 30 wt-% phosphoric acid;

0.5 to 14 wt-% hydrogen fluoride; and 0.5 to 15.5 wt-% acid-soluble aromatic nitro compound, wherein no iron (III) compound is supplied, and wherein merely in the starting phase an oxiding agent can be supplied, which oxidizes iron (II) to form iron (III), wherein said pickling agent is free of wetting and emulsifying agents.

2. The pickling agent of claim 1, comprising:

5.0 to 11 wt-% sulfuric acid or 8.0 to 20 wt-% phosphoric acid;

4.0 to 10 wt-% hydrogen fluoride; and 4.5 to 11 wt-% acid-soluble aromatic nitro compound.

3. The pickling agent of claim 1, further comprising 2.5 to 5.5 wt-% of a magnesium compound.

4. The pickling agent of claim 1, comprising:

9.5 to 15.5 wt-% sulfuric acid or 15.0 to 30.0 wt-% phosphoric acid;

4.0 to 11.0 wt-% hydrogen fluoride, 4.5 to 11.5 wt-% acid-soluble aromatic nitro compound; and 2.5 to 4.5 wt-% magnesium compound.

5. The pickling agent of claim 1, comprising:

12.0 to 16.0 wt-% sulfuric acid or 18.0 to 30.0 wt-% phosphoric acid;

4.5 to 12.0 wt-% hydrogen fluoride;

2.5 to 9.5 wt-% acid-soluble aromatic nitro compound; and 3.0 to 5.5 wt-% magnesium compound.

6. The pickling agent as claimed in claim 1, wherein said acid-soluble aromatic nitro compound comprises m-nitrobenzene sulfonate and/or 3-nitrophthalate.

7. A method comprising applying the pickling agent of claim 1 to a metal surface having corrosion thereon for a sufficient time and under conditions to remove the corrosion from said metal surface without removing metal from the metal surface.

8. The method of claim 7, wherein said surface is stainless steel.

9. The method of claim 8, wherein said metal surface is completely wetted by said pickling agent.

10. The method of claim 7, wherein said pickling agent is applied to said metal surface by brushing, spraying or by immersion in a bath of said pickling agent.

11. The method of claim 9, wherein said pickling agent is a thixotropic gel.

12. The pickling agent of claim 1, further comprising 2.5 to 4.5 wt. % of a magnesium compound calculated as magnesium.

13. A method of descaling a weld seam on a stainless steel surface comprising applying the pickling agent of claim 1 to a weld on a stainless steel substrate under conditions which descale said weld seam.

* * * * *